US007165963B2

(12) United States Patent
Nunley et al.

(10) Patent No.: US 7,165,963 B2
(45) Date of Patent: Jan. 23, 2007

(54) SPINNERET FOR PRODUCING CIRCULAR CROSS SECTION YARN AND PROCESS FOR MAKING THE SAME

(75) Inventors: Lance E. Nunley, Soddy Daisy, TN (US); Ronald E. Steele, Hixson, TN (US)

(73) Assignee: Invista North America S.a.r.l., Wilmington, DE (US)

( * ) Notice: Subject to any disclaimer, the term of this patent is extended or adjusted under 35 U.S.C. 154(b) by 432 days.

(21) Appl. No.: 10/698,163

(22) Filed: Oct. 31, 2003

(65) Prior Publication Data

US 2005/0093199 A1 May 5, 2005

(51) Int. Cl.
*D01D 4/02* (2006.01)

(52) U.S. Cl. ..... 425/382.2; 425/464; 264/211.14; 264/177.13

(58) Field of Classification Search ..... 425/382.2, 425/464; 264/211.14, 177.13
See application file for complete search history.

(56) References Cited

U.S. PATENT DOCUMENTS 4,221,755 A * 9/1980 Wellenhofer et al. ..... 264/169
5,154,908 A * 10/1992 Edie ..... 423/447.1
5,432,002 A 7/1995 Kramer
6,673,442 B1 * 1/2004 Johnson et al. ..... 428/364

* cited by examiner

*Primary Examiner*—Joseph S. Del Sole
(74) *Attorney, Agent, or Firm*—Christina W. Geerlof

(57) ABSTRACT

A melt extrusion spinneret plate has at least one non-circular capillary orifice for producing at least a single filament of circular cross-sectional shape. This non-circular cross-sectional shape of the extrusion capillary, when used to extrude filaments of circular cross-sectional shape, extends the spinneret wipe life by lessening the amount of thermal deposits, which extends the time between wipe cycles. As a result of increased wipe life, the productivity of the process is increased.

3 Claims, 4 Drawing Sheets

SPINNERET FOR PRODUCING CIRCULAR CROSS SECTION YARN AND PROCESS FOR MAKING THE SAME

BACKGROUND OF THE INVENTION

1. Field of the Invention

This invention relates to a spinneret having a non-circular cross-section capillary orifice and process for using this spinneret in the production of polyamide yarns having a circular cross-section. In particular, the invention relates to a spinneret for extruding polyamide filaments and forming yarns comprised of the same filaments.

2. Description of the Related Art

In the manufacture of polyamide multifilament yarns, especially nylon 66 yarns, the winding of the yarn must be stopped frequently to remove undesirable deposits found around the capillary exit side of the spinneret plate. If not removed these deposits build up to a thickness of a "few millimeters (per) week" according to Fourne (*Synthetic Fibers*, Chapter 4, page 359, C. Hanser Publishers, Munich 1998.) Such deposits contributed to the filament bending or "kneeing." The bending of a majority of the filaments, if not remedied, ultimately led to filaments breaks, yarn defects or unscheduled process interruptions and poor efficiency.

A remedy practiced in the art for filament bending or kneeing is to clean these deposits off the extrusion or spinneret plate on the capillary exit face. This cleaning process is also known as "spinneret wiping." The cycle time between spinneret wiping events, where each event is necessitated by a build up of the undesirable deposits, is the spinneret wipe life. It is desirable from a process efficiency and continuity standpoint to have a longer spinneret wiping cycle or wipe life.

In general, the cross sectional shape of a filament is determined by the cross sectional profiled shape of the extrusion orifice. For example, in U.S. Pat. No. 5,432,002 a trilobate profile filament yarn is produced by means of a spinneret plate with multiple orifices of trilobate shape. Whereas, a circular profile filament yarn is produced by a spinneret plate, illustrated at 170 in FIGS. 1*a* and 1*b* with multiple orifices 100 of circular shape.

SUMMARY OF THE INVENTION

Applicants have observed that wiping cycles for production of trilobal profile filaments were in general longer times than those times observed for circular profile cross-section filaments. In particular, Applicants have observed that a non-circular cross-section spinneret capillary orifice (or extrusion orifice) with a cross-sectional area substantially the same as the area of a circular cross-section spinneret capillary, but having a perimeter measure greater than the perimeter of a circular cross-section spinneret capillary, provides greater time interval between spinneret plate wiping events. This non-circular cross-sectional shape of the extrusion capillary, when used to extrude filaments of circular cross-sectional shape, extends the spinneret wipe life by lessening the amount of thermal deposits. This thereby extends the time between wipe cycles. As a result of increased wipe life, the productivity of the process is increased.

Therefore, in accordance with the present invention, there is provided a melt extrusion spinneret plate having at least one capillary orifice for producing at least a single filament of circular cross sectional shape, said capillary orifice having a non-circular shape. Preferably, the capillary orifice has a profiled shape with at least five 5 radially arranged legs, and preferably up to twelve 12 legs. More preferred are eight radially arranged legs.

Further in accordance with the present invention, there is provided a process for making a nylon filament of circular cross sectional shape comprising the steps of: supplying a polymer to a spin beam where the melted polymer is passed to a spin pack and through a spinneret plate having at least a single capillary orifice of non-circular shape, extruding at least a polymer single filament with a jet velocity substantially the same as that jet velocity employed when using a circular cross-section capillary orifice, quenching the freshly extruded filaments with conditioned air, drawing the filament, and winding the filament.

Other objects of the invention will be clear from the following description.

DESCRIPTION OF THE PREFERRED EMBODIMENTS

Figure 1A:
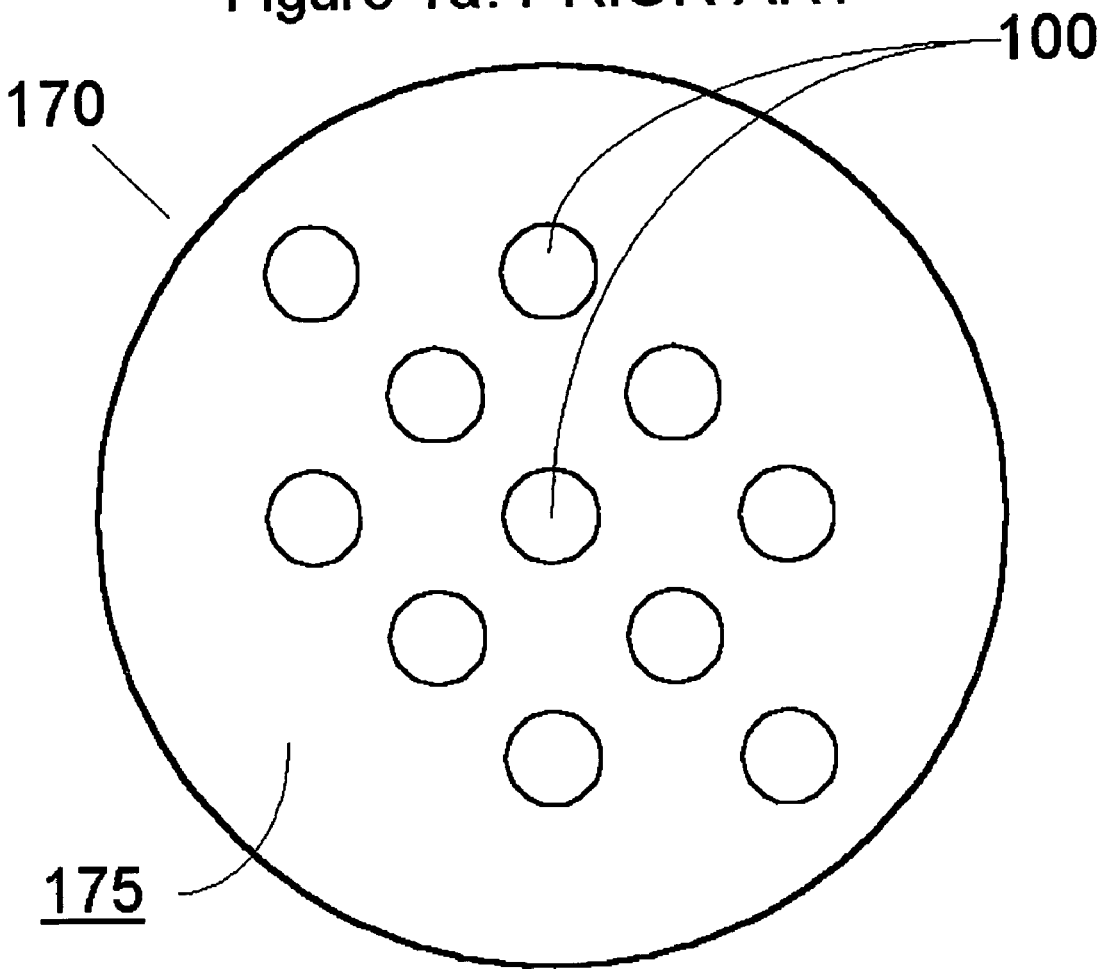
Figure 1a. PRIOR ART
FIG. 1*a* is a representation in plan view of a prior art spinneret plate having a plurality of circular cross section extrusion capillaries.
Figure 1B:
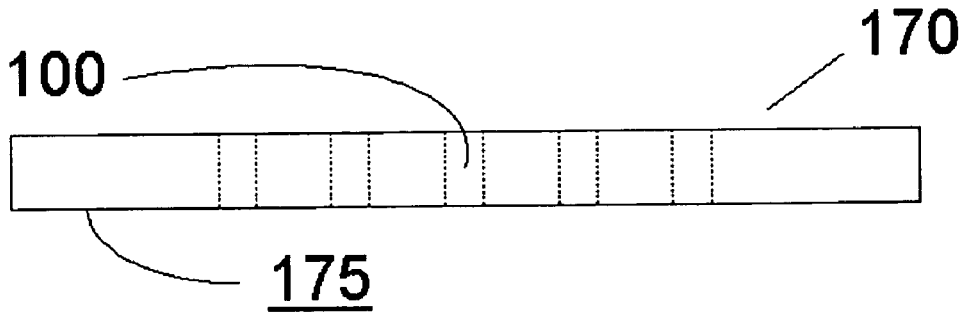
Figure 1b. PRIOR ART
FIG. 1*b* is a representation in elevation view of a prior art spinneret plate having a plurality of circular cross section extrusion capillaries.

Throughout the following detailed description, similar reference characters refer to similar elements in all drawings or figures.

Figure 3A:
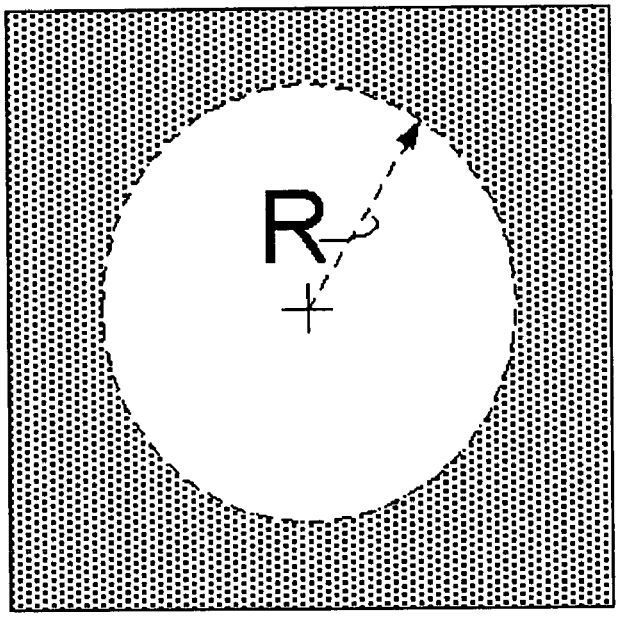
FIG. 3*a* is a representation of a prior art spinneret plate with a single circular cross section extrusion capillary.
Figure 3B:
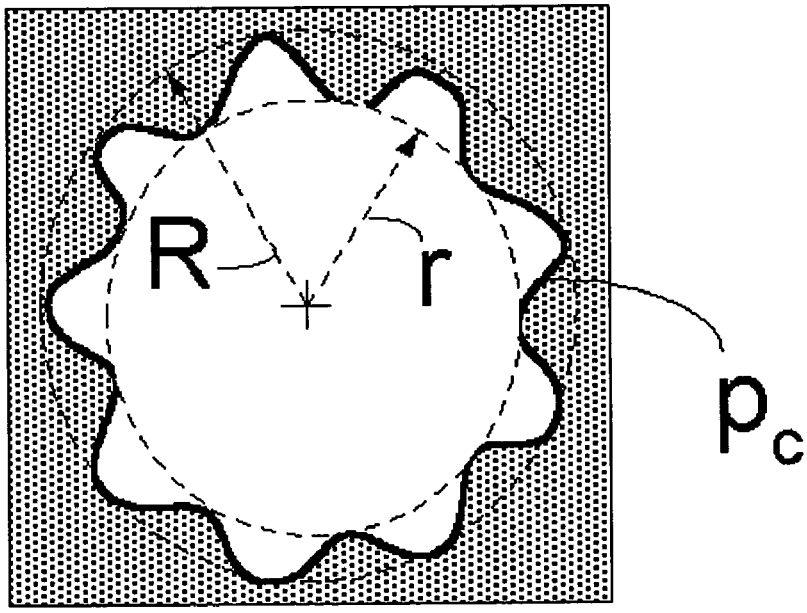
FIG. 3*b* is a representation of an invention spinneret plate with a single non-circular cross section extrusion capillary.

In accordance with the present invention, there is provided an apparatus comprising a melt extrusion spinneret plate comprising at least a single non-circular capillary orifice for making a nylon filament of circular cross sectional shape. A schematic representation of a single capillary orifice is shown in FIG. 3*b*. The non-circular capillary orifice of the spinneret plate for producing a single filament of circular cross sectional shape has a perimeter of non-circular cross sectional shape. The perimeter is characterized by a perimeter measure $p_c$, and an extrusion area, wherein, the perimeter measure $p_c$, is greater than either of: $2\pi R$ and $2\pi r$. The extrusion area for the non-circular cross sectional shape orifice is greater than $\pi r^2$ and less than $\pi R^2$. Herein, r is the radius of the largest circle inscribed by the orifice perimeter and R is the radius of the largest circle circumscribing the orifice perimeter. This relationship is represented in FIG. 3*b*.

In accordance with the present invention, the non-circular capillary orifice of the preferred melt extrusion spinneret plate has a perimeter measure $p_c$ of about 2 to about 10 times greater than either of $2\pi R$ and $2\pi r$. The non-circular capillary orifice of the preferred melt extrusion spinneret plate has about 5 to about 12 radially arranged legs.

Figure 4:
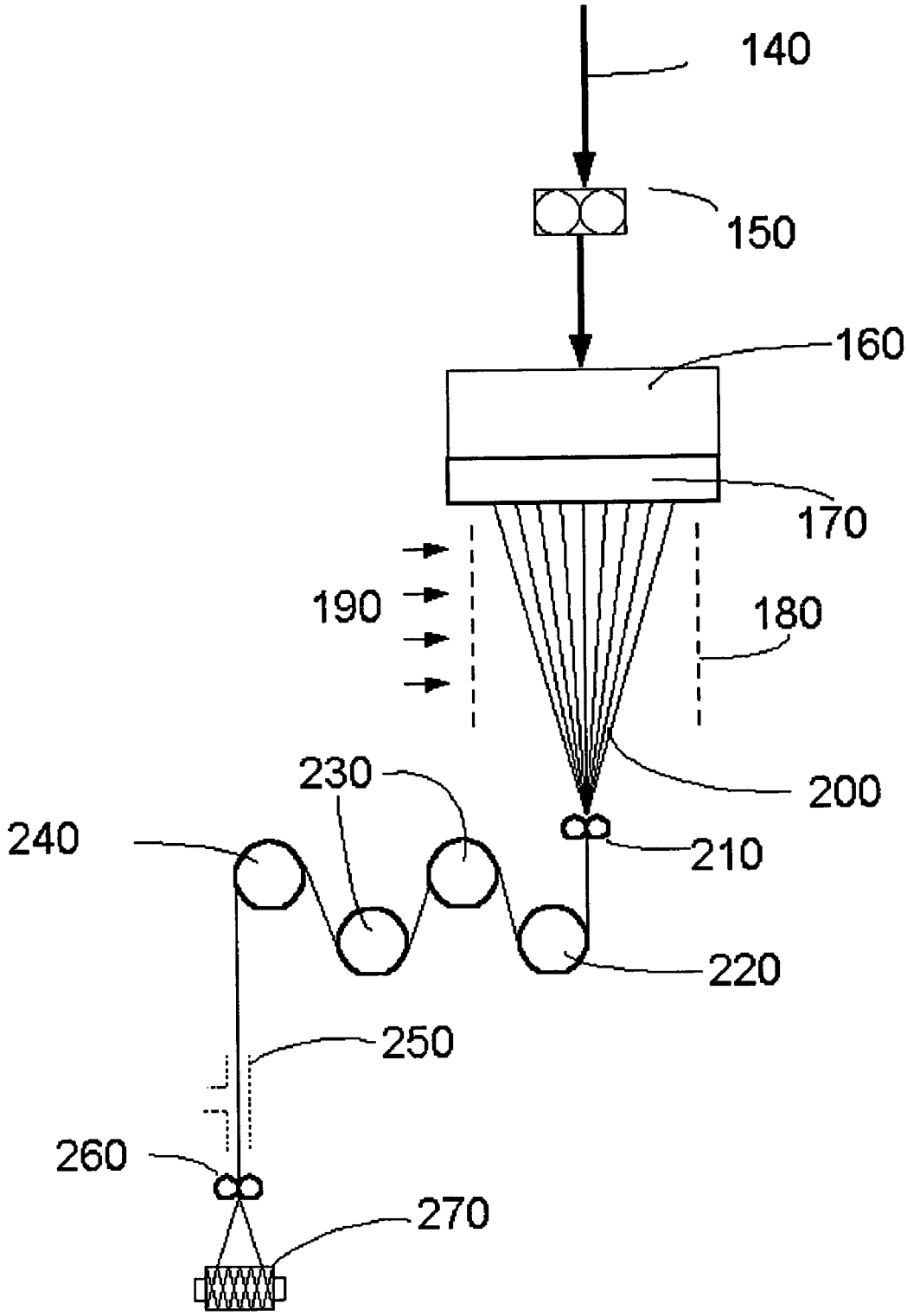
FIG. 4 is a schematic representation of a process in which the invention spinneret plate is useful.

In accordance with the present invention, there is provided a process for making a nylon filament of circular cross sectional shape. A schematic representation of the filament spinning process is shown in FIG. 4. The process comprises the steps of supplying a molten polymer to a spin beam (comprising elements 150, 160 and 170) where a molten polymer is passed to a spin pack. The molten polymer is represented at 140, typically the polymer has an RV in the range of 45 to 60, is conveyed to the spin beam. The polymer is then forwarded by a meter pump 150 and fed at a controlled rate to a spinning filter pack 160.

Figure 2A:
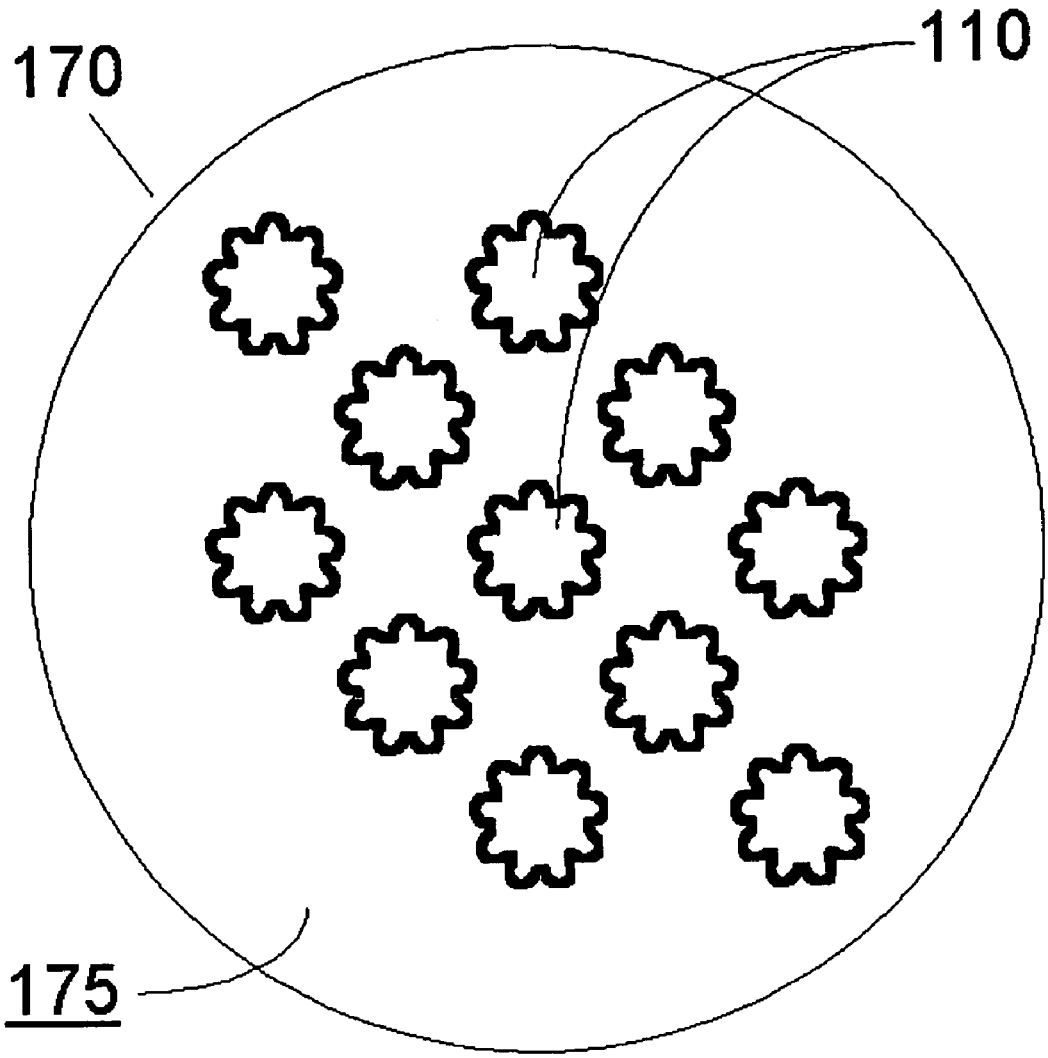
FIG. 2*a* is a representation in plan view of the invention spinneret plate having a plurality of non-circular cross section extrusion capillaries.
Figure 2B:
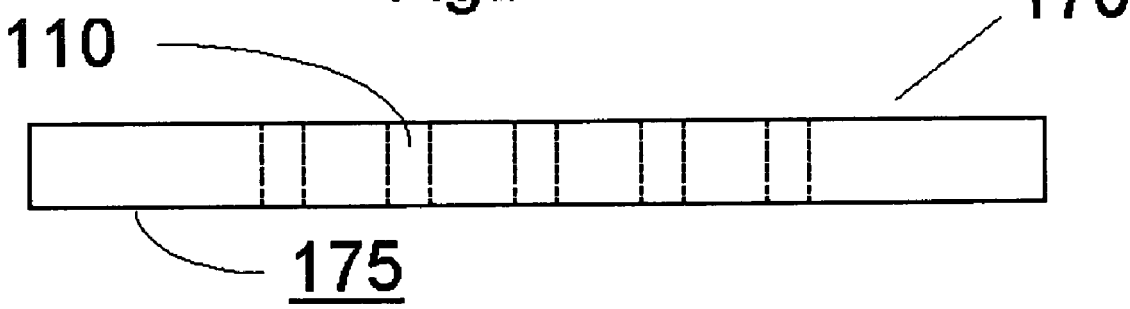
FIG. 2*b* is a representation in elevation view of the invention spinneret plate having a plurality of non-circular cross section extrusion capillaries.

The polymer is then extruded through a spinneret plate 170, shown in FIGS. 2*a*, 2*b* and 4. The spinneret plate has at least a single capillary orifice 110. The capillary orifices correspond to each individual filament comprising the yarn (as represented in side elevation by FIG. 2*b* and plan view by FIG. 2*a*). FIG. 3*b* is a representation the capillary orifices of the present invention as compared to a circular capillary orifice of the prior art represented in FIG. 3*a*. The non-circular cross-section spinneret capillary orifices (or extrusion orifice) of FIG. 3*b* is designed to have a cross-sectional area substantially the same as that area of a circular cross-section spinneret capillary, represented in FIG. 3*a*. At the same time, the perimeter measure $p_c$ of the invention non-circular cross-section orifice is greater than the perimeter measure $2\pi R$ of a circular cross-section spinneret capillary having a radius R. Additionally, the invention orifice is characterized, in the process of the invention, as allowing the polymer extrusion velocity to remain the same as that for a circular extrusion orifice, represented in FIG. 3*a*, with a substantially similar extrusion area. The polymer extrusion velocity is the same as the filament exit velocity from the spinneret capillary. In general, for a certain polymer throughput G (e.g. in grams per minute) per capillary, the following equation applies:

$$G=\rho_{(melt)}D^2_{(capillary)}(\pi/4)\ v_{(extrusion)} \qquad \text{Equation 1.}$$

In this equation, ρ is the polymer melt density (e.g. for melted nylon 6,6@290° C. equal to 1.0 gram per $cm^3$), D (=2R) is the diameter (equal to twice the radius) of the capillary assuming a circular orifice, and v is the velocity of the filament. The extrusion velocity is given by the following equation:

$$v_{(extrusion)}=G(4/\pi)D^2_{(capiliary)}\rho_{(melt)} \qquad \text{Equation 2.}$$

In combination, the perimeter increase in the capillary orifice of the present invention with an unaltered extrusion velocity is thought to provide a longer length of time between spinneret plate wiping events. In a preferred embodiment the polymer is extruded at a jet velocity in the range of 20 centimeters per second to 80 centimeters per second.

In the process of the invention, the freshly extruded filaments are quenched with conditioned air in the known manner. In this step, the individual filaments 200 are cooled in a quench cabinet 180 with a side draft of conditioned air 190 and converged and oiled with a primary finish, known in the art, at 210, into a yarn. The yarn is forwarded by feed roll 220 onto a draw roll pair 230 where the yarn is stretched and oriented to form a drawn yarn which is directed by roll 240 into a yarn stabilization apparatus 250, commonly used in the art and here optionally employed as a yarn post-treatment step. Finally, the yarn is wound up as a yarn package at 270, at a yarn speed in the range of 4500 to 6500 meters per minute, and preferably 5000–6000 meters per minute. The yarn RV measured is about 51 to about 54. During the course of winding at these speeds any need to interrupt the process for the purpose of cleaning the exit side face of the spinneret plate dramatically affects the productivity. Essentially all product which could have been wound up is sent to waste while the spinneret plate is wiped.

Using the spinneret plate of the invention, having extrusion orifices of non-circular cross section, to spin filaments of circular cross sectional shape provides a process with a reduced need for spinneret wiping due to bent filaments. The number of bent filaments at the exit side 175 of the face of the spinneret plate 170 with the present invention may be counted directly by observation and recorded for a typical eight-hour shift after spinneret plate wiping. The record is indicative of how robust the process is from a bent filament production rate. Similarly, the spinneret wipe life expressed as the time for 10% of all single filaments in the yarn bundle to appear bent at the exit side of the capillary on the spinneret plate face is also recorded. Measuring the time to 10% bent filaments is performed directly by observation and a direct count by an operator illuminating the spinneret plate face within the quench cabinet.

The yarn produced according to the process represented by FIGS. 4 is a drawn yarn with elongation of 22 to about 60%, the boiling water shrinkage is in the range of 3 to about 10%, the yarn tenacity is the range of 3 to about 7 grams per denier, and the RV of the yarn can be varied and controlled well within a range of about 40 to about 60. The yarn is a dull luster multifilament polyamide yarn. A preferred nylon filament of the invention is delustered with a pigment such as titanium dioxide in an amount of 0.03 to 3 percent by weight.

A derived parameter characterizing the superior properties of this yarn is called the Yarn Quality and found by the product of the yarn tenacity (grams per denier) and the square root of the % elongation, as in Equation 3.

$$\text{YARN QUALITY}=\text{tenacity}\times(\text{elongation})^{1/2} \qquad \text{Equation 3.}$$

The Yarn Quality is an approximation to the measure of yarn "toughness." As is known to those skilled in the art, the area under the yarn load elongation curve is proportional to the work done to elongate the yarn. Where tenacity is expressed in terms of force per unit denier, for example, and the elongation expressed as a per cent change per unit of length, the load elongation curve is the stress-strain curve. In this case the area under the stress-strain curve is the work to extend the yarn or the yarn toughness. The yarn quality improvement provides an apparel polyamide yarn which is more acceptable in varied applications. These applications may include, without limitation, warp knit fabrics, circular knit fabrics, seamless knit garments, hosiery products and light denier technical fabrics.

Test Methods

Yarn tenacity and the yarn elongation are determined according to ASTM method D 2256-80 using an INSTRON tensile test apparatus (Instron Corp., Canton, Mass., USA 02021) and a constant cross head speed. Tenacity is expressed as grams of force per denier, the elongation percent is the increase in length of the specimen as a percentage of the original length at breaking load.

Yarn Quality derived from tenacity and elongation and is calculated according to Equation 3.

Polymer relative viscosity RV is measured using the formic acid method according to ASTM D789-86.

EXAMPLES

Example of the Invention

In an example of the invention, a yarn of 40 denier (44 dtex) and 13 filaments was prepared from a nylon 66 polymer of 51.5 RV which contained 1.5% by weight $TiO_2$. This polymer was melted in an extruder and fed to a spinning machine (shown schematically in FIG. 4.) which was used to prepare the yarn, by a process of quenching in conditioned air, converging and treating the yarn with a primary spinning oil, drawing the yarn using unheated godets, stabilizing the yarn with a heated fluid, interlacing the yarn and winding on at a speed of about 5300 meters per minute. The spinneret plate had 13 non-circular cross-sectional shape cross-sectionally shaped capillaries with 9 radially protruding "legs", as shown in FIG. 3*b*. The perimeter measure of a single capillary, represented in FIG. 3*a*, was 120 micrometers. Under these spinning conditions, the jet velocity of the polymer through this capillary was 100 feet per minute (50.8 cm per second). During the course of preparing the example yarns the spinneret plate 170 on the capillary exit face 175 (in plan view by FIG. 2*a*.) required wiping each 10 hours of yarn winding since at least 10% of the filaments were bent. The yarn produced had a circular cross-sectional shape. The RV, the tenacity and elongation of the wound up 40-13 yarn was measured. The RV was 52.5. The tenacity and elongation measurements were used to calculate a "yarn quality" parameter using Equation 3. The parameter is related to the yarn toughness or work needed to draw the yarn and found here to be 33.1.

Comparative Example

In a comparative example of the prior art, a yarn of 40 denier (44 dtex) and 13 filaments was prepared by treating a nylon 66 polymer (51.5 RV) was melted in an extruder and fed to a spinning machine which was used to prepare the 40-13 yarn, by a process of quenching in conditioned air, converging and treating the yarn with a primary spinning oil, drawing the yarn using unheated godets, stabilizing the yarn with a heated fluid, interlacing the yarn and winding on at a speed of about 5300 meters per minute. The spinneret plate had 13 circular cross-sectionally shaped capillaries, as shown in FIG. 3*a*. The perimeter measure of a single capillary, represented in FIG. 3*a*, was 22 micrometers. Under these spinning conditions, the jet velocity of the polymer through this capillary was 100 feet per minute (50.8 cm per second). During the course of preparing this circular cross-sectionally shaped yarn the spinneret plate 170 on the capillary exit face 175 required wiping each 1.5 hours of yarn winding, since at least 10% of the filaments were bent. The tenacity and elongation of the wound up 40-13 yarn was measured exactly as in the example of the invention. The measured RV was of this yarn was 52.5 RV as before. The tenacity and elongation were used to calculate a "yarn quality" parameter, which was found to be 31.5 using Equation 3.

As a result of these modifications to the perimeter measure, an increase of about 6 times, and the shape of the spinneret plate capillaries an increased productivity spinning process is realized. Most importantly, the need to interrupt the process continuity is reduced to about 2 times per 24 hour period from that of 6 or more times per 24 hour period.

What is claimed is:

1. A melt extrusion spinneret plate having at least one capillary orifice for producing at least a single filament of circular cross sectional shape, said orifice having a perimeter of non-circular cross sectional shape, a perimeter measure $p_c$, and an extrusion area, wherein, said perimeter measure, $p_c$, is greater than $2\pi R$, and further wherein, said extrusion area is greater than $\pi r^2$ and less than $\pi R^2$, and further wherein, r is the radius of the largest circle inscribed by the orifice perimeter, R is the radius of the largest circle circumscribing the orifice perimeter; and wherein the orifice has a cross-sectional area substantially the same as that area of a circular cross-section spinneret capillary having a radius R.

2. The melt extrusion spinneret plate according to claim 1, wherein said perimeter measure, $p_c$, is 2 to 10 times greater than either of $2\pi R$ and $2\pi r$.

3. The melt extrusion spinneret plate according to claim 1, wherein the orifice has 5 to 12 radially arranged legs.

* * * * *